US005371905A

United States Patent [19]

Keim

[11] Patent Number: 5,371,905

[45] Date of Patent: Dec. 13, 1994

[54] NECK AND SPINE PROTECTION DEVICE

[76] Inventor: Hugo A. Keim, Silver Dollar No. 38, 17000 Patterson Rd., Odessa, Fla. 33556

[21] Appl. No.: 114,483

[22] Filed: Aug. 31, 1993

[51] Int. Cl.[5] ..... A42B 1/06

[52] U.S. Cl. ..... 2/413; 2/425

[58] Field of Search ..... 2/2, 3 R, 421, 425, 2/44, 45, 415, 416, 417, 419, 422, 413, 411, 420; 602/5, 12, 16, 17, 18, 19

[56] References Cited

U.S. PATENT DOCUMENTS

| | | | |
|---|---|---|---|
| 3,134,106 | 5/1964 | Shaffer et al. | 2/2 |
| 3,759,550 | 9/1973 | Peress | 2/2.15 |
| 3,855,631 | 12/1974 | Ettinger | 2/2 |
| 3,900,896 | 8/1975 | Ackerman | 2/2 |
| 3,978,525 | 9/1976 | Bothwell | 2/424 |
| 4,094,015 | 6/1978 | Howard | 2/415 |
| 4,219,193 | 8/1980 | Newman | 272/94 |
| 4,471,538 | 9/1984 | Pomeranz et al. | 2/159 |
| 4,821,339 | 4/1989 | Fair | 2/2 |
| 4,996,720 | 3/1991 | Fair | 2/2 |
| 5,123,408 | 6/1992 | Gaines | 602/17 |
| 5,261,125 | 11/1993 | Cartwright et al. | 2/421 |

FOREIGN PATENT DOCUMENTS 1503483 of 0000 United Kingdom .

OTHER PUBLICATIONS

Football Caps Reduce Impact, *Machine Design,* Jan. 8, 1993, p. 16.

Helmet to Save Neck.

*Primary Examiner*—Clifford D. Crowder
*Assistant Examiner*—Larry D. Worrell, Jr.
*Attorney, Agent, or Firm*—Rudnick & Wolfe

[57] ABSTRACT

A neck and spine protection device comprised of a helmet for head protection, pads for shoulder protection and a fluid dampening mechanism. The fluid dampening mechanism is connected between the helmet and pads. The fluid dampening mechanism has limits at either end to limit hyper-flexion and hyper-extension injuries of the neck and spine in sudden impact situations.

5 Claims, 3 Drawing Sheets

NECK AND SPINE PROTECTION DEVICE

FIELD OF THE INVENTION

The present invention relates generally to a device for neck protection, and more particularly, to a device for neck protection for athletes to try and reduce the chance of neck and spinal injuries.

BACKGROUND OF THE INVENTION

In the past, football players and other athletes have sustained serious injury from sudden impact to the head, neck and shoulders. In order to prevent injuries to the players a variety of different protection devices have been developed, i.e., helmets and shoulder pads. However, these devices are not sufficient to protect the neck and spine of an athlete. Consequently, in instances of sudden impact from the front or the rear, a player can sustain hyper-extension or hyper-flexion injuries to the neck which can also effect the cervical spine. Such injuries can result in either whiplash, partial paralysis, total paralysis, and, in extreme circumstances, even death. While there have been attempts in the past to provide devices to protect the neck and spine, none of these devices has found great acceptance within the field. Those devices available usually unduly restrict the player's movement of the head making it difficult to participate in the sport.

SUMMARY OF THE INVENTION

In view of the above, and in accordance with the present invention, there is provided a neck and spine protection device that is comprised of a helmet for head protection, pads for shoulder protection, and a fluid dampening mechanism. The dampening mechanism is connected between the helmet and the shoulder pads.

The device allows for normal movement of a player's head. In sudden impact situations, however, the fluid dampening mechanism restricts the movement of the head thereby reducing the chance of hyper-flexion and hyper-extension injuries of the neck and spine. The coupling mechanism between the fluid dampening mechanism and the helmet is a connect/disconnect type. In this manner, the helmet can be easily detached from the fluid dampening mechanism.

It is therefore the object of the present invention to provide adequate protection to the neck in sudden impact situations while still offering a football player or other athlete movement of the head in order to effectively participate in the sport.

Numerous other features and advantages of the present invention will become readily apparent from the following detailed description, the accompanying drawings, and the appended claims.

DETAILED DESCRIPTION OF THE PRESENT INVENTION

Figure 1:
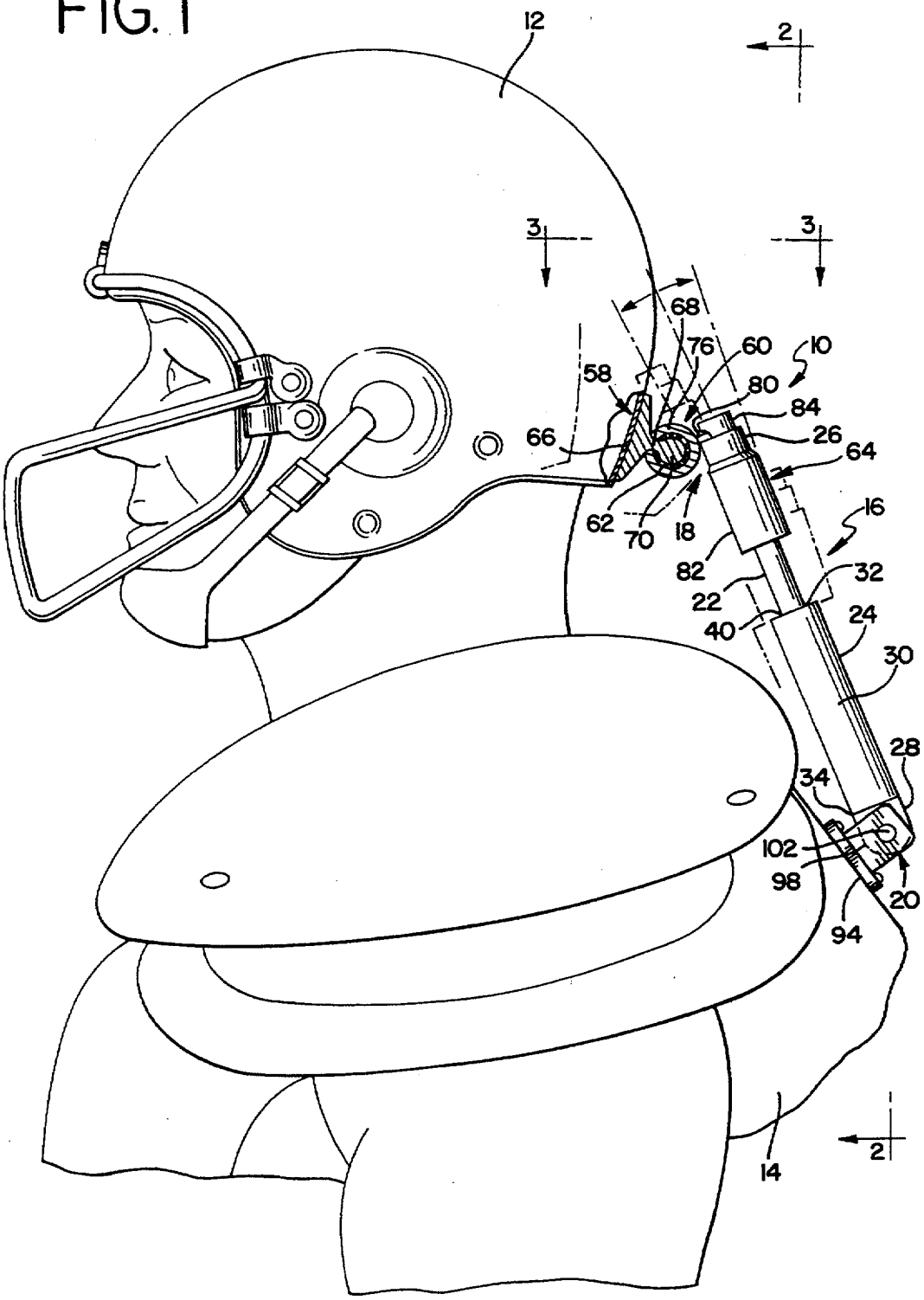
FIG. 1 is a side view of the neck protection device of the present invention with a cross-sectional view of the first coupling mechanism.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Figure 2:
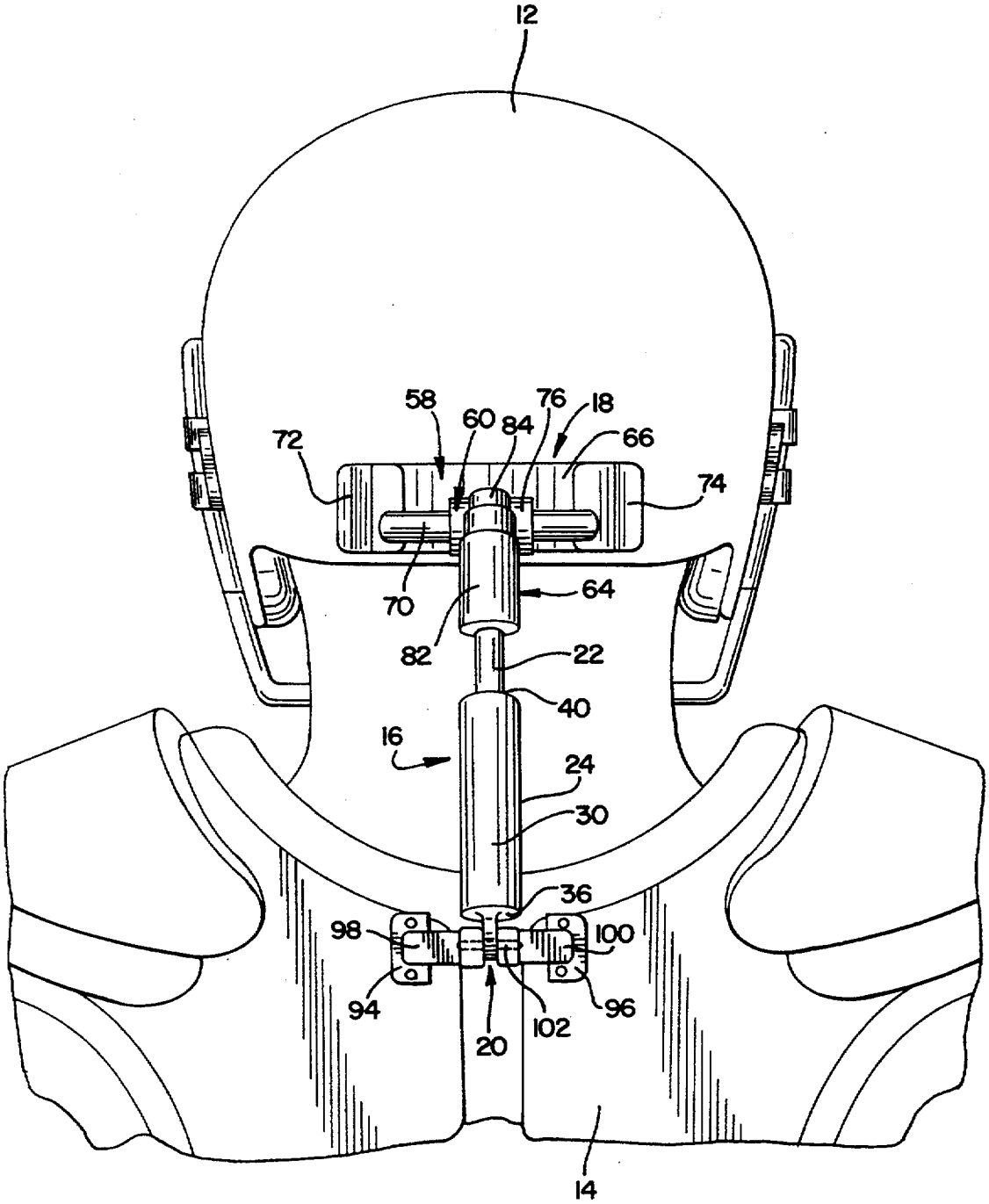
FIG. 2 is a rear view of the neck protection device of the present invention.

Referring now to the drawings, wherein like reference numerals indicate like parts throughout the several views, there is shown in FIG. 1 a neck protection device, generally designated by reference numeral 10. Device 10 generally includes a helmet 12, shoulder pads 14, and a fluid dampening mechanism, generally indicated at 16. Helmet 12 and shoulder pads 14 are those that are typically used by football players, or they could be similar equipment worn by equestrians or the like. As seen in FIGS. 1 and 2, the fluid dampening mechanism 16 is connected between both the helmet 12 and the shoulder pads 14. The connection is made by a first coupling mechanism, generally indicated by 18, between the helmet 12 and the fluid dampening mechanism 16 and second coupling mechanism 20 between the pads 14 and the fluid dampening mechanism 16.

The fluid dampening mechanism 16 has a rod 22 that fits into a fluid type cylinder 24. This arrangement of the rod 22 and fluid type cylinder 24 makes the fluid dampening mechanism 16 act like a shock absorber and gives the mechanism a rod end 26 and a cylinder end 28.

Figure 3:
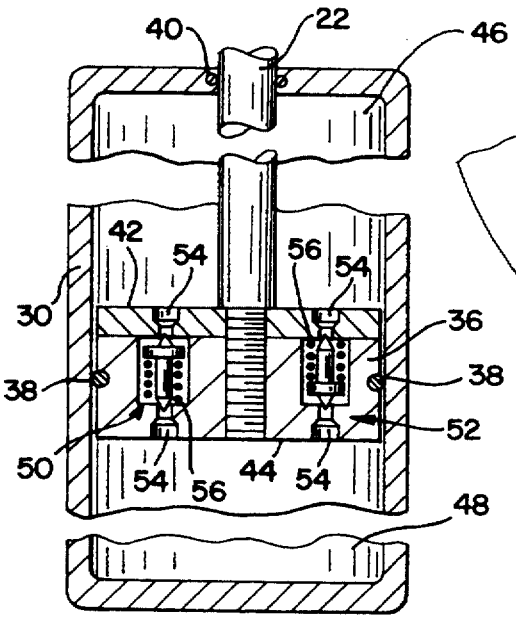
FIG. 3 is a cross section view of the fluid dampening mechanism taken along the line 3—3 in FIG. 2.

As illustrated in FIG. 3, the fluid type cylinder 24 includes a sealed casing 30 having two closed ends 32 and 34. A piston 36 is arranged to lengthwise move within the casing 30 and is sealed to an interior of the casing as by a ring 38. As shown, rod 22 is suitably connected to the piston 36 and extends through and beyond the end 32 of casing 30. A suitable fluid seal 40 is provided in combination with casing 30 to allow for enclosure reciprocal movement of the rod 22 relative to the cylinder 24 without detracting from the sealed capacity of casing 30.

Piston 36 is provided with two major surfaces 42 and 44 provided on opposite sides of the ring 38. The distance between the sealed end 32 of casing 30 and piston surface 42 defines a first fluid receiving chambers 46. The distance between end 34 of casing 30 and piston surface 36 defines a second fluid receiving chamber 48. As will be appreciated, the volume of each chambers 46 and 48 varies depending upon the axial position of the piston 36 relative to the casing 30.

Each chamber 46 and 48 has a fluid entrapped therewithin. Preferably equal fluid volumes are provided in each chambers 46 and 48. However, the volume of fluid contained within each chamber, when the piston 36 is positioned approximately midstroke, can be somewhat less than the volumetric capacity of each chambers 46 and 48. In a most preferred form of the invention, the fluid contained in each chambers 46 and 48 is a hydraulic fluid. If should be appreciated, however, that other forms of fluid may be provided in combination with the cylinder 24 without detracting from the spirit and scope of the present invention.

Piston 36 further includes a pair of valves 50 and 52 which operate in opposite phases from each other. The purpose of each valves 50 and 52 is to control the fluid flow through the piston 36 and thereby control the dampening effect provided by cylinder 24. In the illustrated embodiment, the valves 50 and 52 are substantially identical and thus only valve 50 will be discussed in detail below with the understanding that valve 52 is similarly constructed.

The orifices 54 allow the fluid within the cylinder 24 to flow through the piston 36. The springs 56 are within piston 36 and are biased so that they will overcome the flow of fluid and dampen the movement of the piston 36 when the piston 36 approaches the casing ends 32 and 34 of the cylinder 24 in sudden impact situations. In these situations, the force of fluid through the piston 36 will cause the springs 56 to restrict the movement of the piston 36. Accordingly, the fluid dampening mechanism 16 acts like a shock absorber. The movement of the piston 36 through the cylinder 24 allows the head for approximately 30 degrees of movement up and down.

The first coupling mechanism 18 connects the helmet 12 to the rod end 26 of the fluid dampening mechanism 16. In the illustrated embodiment, the first coupling mechanism 18 is comprised of a guide rail generally indicated at 58, a bearing block 60, bearings 62, and a locking mechanism, generally indicated at 64.

The guide rail 58 has a connection end 66, a neck 68 and a bar 70 and is shaped to generally correspond to the curve of the lower rear portion of the helmet. The connection end 66 connects the guide rail to the helmet 12. The guide rail 58 is attached to the helmet 12 by a suitable adhesive or can be formed on the helmet 12 at the time of manufacture. The guide rail 58 is positioned at the center of the lower rear portion of helmet 12. In the illustrated embodiment, the bar 70 is cylindrical in shape and separated from the connection end 66 by the neck 68. Neck 68 and bar 70 preferably run the length of guide rail 58 to add strength and rigidity to the guide rail 58. At the two ends of the guide rail 58 are first and second stops 72 and 74.

Figure 6:
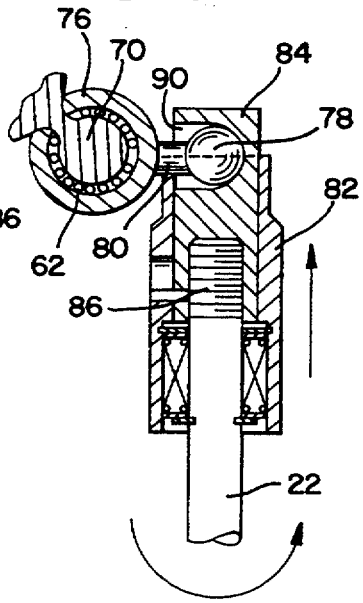
FIG. 6 is a cross sectional view of the locking mechanism and bearing block taken along the line 6—6 in FIG. 5.

As seen in FIG. 6, the bearing block 60 has a generally C-shaped end 76 and a ball 78. Between the C-shaped end 76 and ball 78 there is a separator 80. The radius of the C-shaped end 76 is larger than that of the bar 70. Accordingly, the C-shaped end 76 surrounds the bar 70, and between the C-shaped end 76 and bar 70 are positioned the bearings 62. The bearings 62 faciliates the bearing blocks 60 sliding movement along the guide rail 58 as the head moves.

Figure 4:
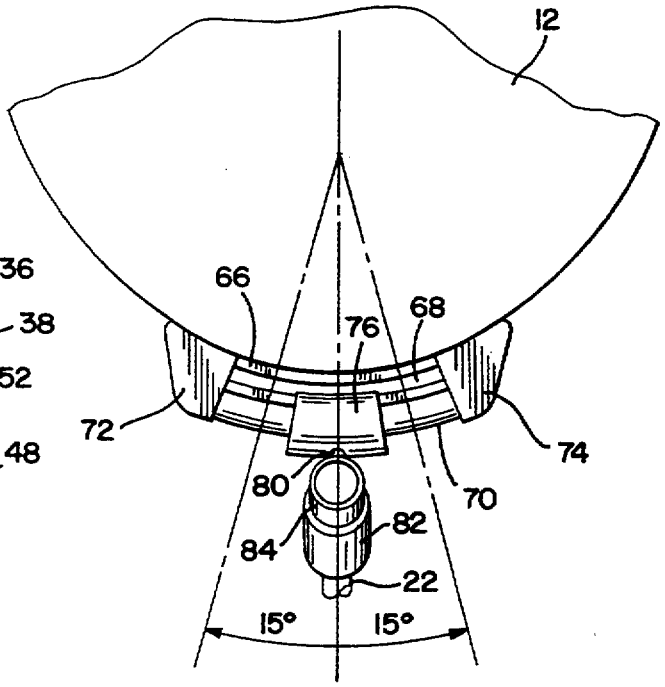
FIG. 4 is a top view of the present invention.

FIGS. 2 and 4 illustrates that the bearing block 60 moves along the guide rail 58 between the first and second stops 72 and 74. FIG. 4 illustrates that the distance between the first and second stops 72 and 74 is sufficiently large to allow adequate movement of the head, which is approximately 15 degrees to the left and to the right of center.

Figure 5:
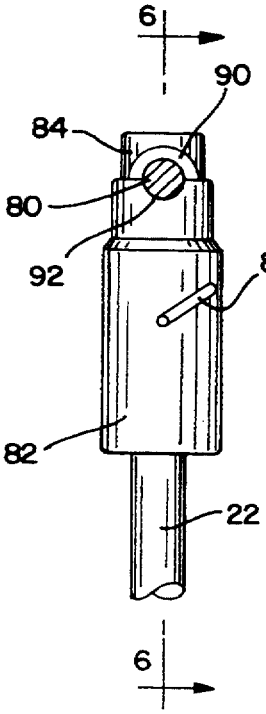
FIG. 5 is a view of the locking mechanism of the first coupling device in the open position.

FIG. 5 illustrates the locking mechanism 64 of the first coupling mechanism 18 in a locked, or closed, position. As seen in FIG. 6, locking mechanism 64 includes a rotating portion 82, a cap 84, and a spring 86. One end of cap 84 has a bore 88 which is approximately the diameter of rod 22 so that the cap fits securely over the rod end 26. Accordingly, the locking mechanism 64 is attached to the fluid dampening mechanism 16. A socket 90 is position within the opposite end of cap 84 from bore 88. The socket 90 is a sufficient size to hold the ball 78. Beneath the cap and surrounding the rod 22 is spring 86. Rotating portion 82 fits over both the cap 84 and the rod 22 and encapsulates a portion of the cap 84 and the spring 86. The upper end of the rotating portion has a detent 92. As shown in the drawings, the cap 84 and rotating portion 82 are preferably cylindrical.

The rotating portion 82 can be moved between a locked position and an unlocked position. The spring 86 is positioned within the rotating portion 82 to normally maintain the locking mechanism in its locked position. In the locked position, the detent 92 is positioned over the socket 90. In this position, a large enough portion of the socket 90 is revealed for separator 80 to fit through. Spring 86 is compressed as the rotating portion 82 is moved from its locked position to its unlocked position. When the rotating portion 82 is released from the unlocked position, the spring 86 returns it to the locked position.

Referring again to FIGS. 1 and 2, the second coupling mechanism 20 attaches the fluid dampening mechanism 16 to the shoulder pads 14. As shown in the drawings, the second coupling mechanism 20 is a typical clevis type mount having plates 94 and 96, parallel supports 98 and 100, and a pin 102. Plates 94 and 96 are secured to the shoulder pads 14. Parallel supports 98 and 100 are a part of the plates 94 and 96, respectively. Parallel supports 98 and 100 are separated by a small space that is sufficiently wide enough for cylinder end 28 to securely fit into. Pin 102 secures parallel supports 98 and 100 and cylinder end 34 together so that the fluid dampening mechanism 16 can rotate about the pin 102. It should be noted that an arrangement can be used when the parallel supports are a part of the same plate.

The second coupling mechanism 20 permits the head to move both to the right and left as well as forward and backward. The second coupling mechanism 20 also allows the fluid dampening mechanism 16 to rotate about the pin 102 when the fluid dampening mechanism 16 is separated from the helmet 12. It should be noted, however, that the other types of mounts can be used that also allow for sufficient movement of the head and the fluid dampening mechanism 16.

A mode of operation of the preferred embodiment will now be explained. An athlete will initially put on shoulder pads 14 that have the fluid dampening mechanism 16 already attached to it by the second coupling mechanism 20. When the athlete is prepared to play, the helmet 12 will be put onto the athlete's head, and the fluid dampening mechanism 16 will be connected to the helmet 12 by the first coupling mechanism 18.

Figure 7:
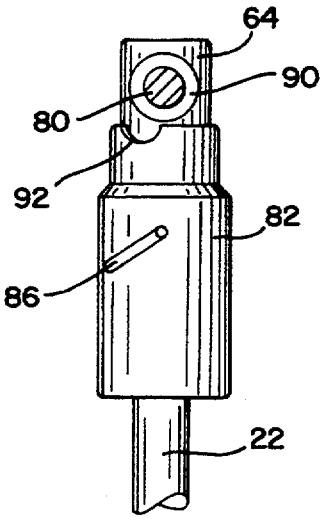
FIG. 7 is a view of the locking mechanism in the closed position.

To connect the fluid dampening mechanism 16 to the helmet 12, the ball 78 needs to be inserted into the socket 90. The rotating portion 82 is pulled down and rotated clockwise from the closed position of FIG. 5 to the open position of FIG. 7 to provide access to the socket 90. In the open position, the ball 78 is inserted into the socket 90. When the rotating portion 82 is released, the spring 86 returns the rotating portion 82 to the closed position. In the closed position, the rotating portion 82 and the detent 92 secure the ball 78 into the socket 90 and surrounds the separator 80. The ball 78 and socket 90 arrangement allows for adequate head movement under normal conditions.

To disconnect the helmet 12 from the fluid dampening mechanism 16, the rotating portion 82 is rotatably moved from its locked position to its unlocked position where it is held. The ball 78 is then removed from the socket 90 whereby the rotating portion 82 can then be released. Consequently, the different positions of the locking mechanism 64 provide for a quick connect/disconnect between the helmet and the fluid dampening mechanism 16.

Under normal playing conditions, the athlete's head will be able to move easily as the fluid flows through the valves 50 and 52 of the internal piston 36. The response of the fluid dampening mechanism 16 will vary depending on the location of the internal piston 36 within the cylinder 24. As the internal piston 36 moves within the fluid environment of the cylinder 24, the pressure increases on the side of the internal piston 36 corresponding to the casing ends 32 and 34 to which the internal piston 36 is moving towards. Accordingly, the biasing of the springs 56 and the flow of the fluid through the orifices 54 allow the head to move smoothly as the internal piston 36 moves between the casing ends 32 and 34.

In sudden impact situations, however, the movement of the internal piston 36 within the cylinder 24 is designed to prevent hyper-extension and hyper-flexion of the neck. In the sudden impact situations, the speed at which the internal piston 36 moves through the fluid environment is greater than that of non-sudden impact situations. As the speed of the piston 36 increases the corresponding pressure of the fluid within the cylinder 24 increases thereby making it difficult for the piston to move as easily through the cylinder 24. The arrangement of springs 56 and orifices 54 will no longer allow a balance in pressure of the fluid within the cylinder 24. The increased pressure within the cylinder 24 restricts the movement of the piston thereby restricting the movement of the head. In this manner, the piston 36 is dampened as it reaches the casing ends 32 and 34 thereby reducing the chances of hyper-extension and hyper-flexion of the neck.

As will be appreciated, the locking mechanism 64 could be between the fluid dampening mechanism 16 and the shoulder pads 14 and mounted to the helmet 12. In this arrangement, the fluid dampening mechanism would be attached to the helmet 12 and be able to quick connect/disconnect to the shoulder pads 14. Furthermore, the chance for hyper-extension and hyper-flexion injuries are reduced by the limit positions of the piston 36 within the cylinder 24 thereby restricting the movement of the head beyond certain distances.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A neck and spine protection device to be worn by a person comprising:

a helmet for head protection;

pads for shoulder protection;

a fluid dampening mechanism having a rod and a fluid type type cylinder including a casing with two ends, said casing having fluid therewithin, said piston being connected to said rod and movable between said ends of said casing and having at least two valves operable in opposed relation relative to each other so that fluid can flow through said piston and said valves, with one valve restricting movement of the internal piston as it approaches one end of said casing and the other valve restricting movement of the internal piston as it approaches the other end of the casing;

a first coupling between said pads and said fluid dampening mechanism; and a second coupling between said rod and said helmet, said second coupling including a guide rail connected to said helmet having a bar extending the length of said guide rail and a first and second stop at each end of said bar;

a bearing block having a ball at one end and a C-shaped end at another end, said C-shaped end surrounding said rod;

bearing placed between said C-shaped end and said bars so that said C-shaped end can easily move between said first and second stops; and a locking mechanism connected to said rod having a socket and a rotating portion, said rotating portion being spring released between a locked position and an unlocked position, wherein said locking mechanism secures said ball in said socket in said locked position and allows said ball to be moved from said socket in said unlocked position.

2. A neck and spine protection device to be worn by a person comprising:

a helmet for head protection;

pads for shoulder protection;

a fluid dampening mechanism to limit hyper-flexion and hyper-extension of the neck and spine in sudden impact situations, said fluid dampening mechanisms having a first end and a second end;

a first coupling mechanism to attach said end of said fluid dampening mechanism to said helmet, said first coupling mechanism allowing movement of the head; and a second coupling mechanism to attach said second end of said fluid dampening mechanism to said pads; and wherein said first coupling mechanism comprises a locking mechanism having a cap and a rotating portion and cap having a bore to one end and a socket in the side thereof, said rod fitting into said bore, and said rotation portion having a locked position and an unlocked position;

a guide rail connected to said helmet said guide rail having a first stop at one end and a second stop at another end;

bearings; and a beating block to hold said bearings against said guide rail so that said beating block moves along said guide rail between said first and second stops as the head moves, said bearing block having a ball-end that fits into said socket to attach said fluid dampening mechanism to said helmet and a C-shaped end to connect said beating block to said guide rail.

3. A neck and spine protection device according to claim 2 wherein said ball is secured into said socket when said rotating portion is in said locked position and said ball can be removed from said socket when said rotation portion is in said unlocked position and wherein said locking mechanism having a spring to keep said rotating portion in said locked position and allowing for a quick connect/disconnect of said ball from said socket.

4. A neck and spine protection device according to claim 2 wherein said guide rail allows the head to rotate about 30 degrees between said first and second stops.

5. A neck and spine protection device according to claim 2 wherein said rod moves into and out of said fluid type cylinder to allow the head to move about 30 degrees forward and backward.

* * * * *

UNITED STATES PATENT AND TRADEMARK OFFICE

CERTIFICATE OF CORRECTION

PATENT NO. : 5,371,905

DATED : December 13, 1994

INVENTOR(S) : Hugo A. Keim

It is certified that error appears in the above-identified patent and that said Letters Patent is hereby corrected as shown below:

Column 5, Line 62, after "having" insert --an internal piston and--

Column 6, Line 52, change "beating" to --bearing--

Signed and Sealed this

Eighteenth Day of April, 1995

*Attest:*

*Attesting Officer*

BRUCE LEHMAN

*Commissioner of Patents and Trademarks*